US008657114B2

(12) United States Patent
Oates et al.

(10) Patent No.: US 8,657,114 B2
(45) Date of Patent: Feb. 25, 2014

(54) PACKAGE WITH CONTRASTING GRAPHICS

(75) Inventors: Susan Mary Oates, Appleton, WI (US); Anne Marie Jones, Neenah, WI (US); David Flippin Woltz, Ladue, MO (US); Jennifer Lea Westemeyer, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 451 days.

(21) Appl. No.: 13/153,032

(22) Filed: Jun. 3, 2011

(65) Prior Publication Data

US 2012/0305576 A1 Dec. 6, 2012

(51) Int. Cl.
*B65D 73/00* (2006.01)

(52) U.S. Cl.
USPC ..... 206/459.5; 40/312

(58) Field of Classification Search
USPC ..... 206/459.1, 459.5, 494, 438, 440, 812; 40/312
See application file for complete search history.

(56) References Cited

U.S. PATENT DOCUMENTS

| | | | | |
|---|---|---|---|---|
| 5,839,585 | A | 11/1998 | Miller | |
| D409,389 | S | 5/1999 | May et al. | |
| D433,796 | S | 11/2000 | Zack | |
| D439,735 | S | 4/2001 | Velazquez et al. | |
| D440,398 | S | 4/2001 | Mitchler et al. | |
| 6,454,095 | B1 | 9/2002 | Brisebois et al. | |
| 6,520,330 | B1 | 2/2003 | Batra | |
| 6,708,823 | B2 | 3/2004 | Cottingham et al. | |
| 6,923,321 | B2 | 8/2005 | Samolinski et al. | |
| 7,172,073 | B2 * | 2/2007 | Hanson | 206/733 |
| 7,356,182 | B1 | 4/2008 | Fleisher et al. | |
| D656,013 | S | 3/2012 | Norman et al. | |
| D656,396 | S | 3/2012 | Palmieri et al. | |
| D658,056 | S | 4/2012 | Hughes et al. | |
| 8,157,777 | B2 | 4/2012 | Ito et al. | |
| D659,011 | S | 5/2012 | Lee | |
| 2002/0027563 | A1 * | 3/2002 | Van Doan et al. | 345/630 |
| 2002/0072723 | A1 | 6/2002 | Ronn et al. | |
| 2002/0148749 | A1 | 10/2002 | Briseboi et al. | |
| 2003/0088224 | A1 | 5/2003 | Ceman et al. | |
| 2003/0097109 | A1 | 5/2003 | Bruce et al. | |
| 2004/0102748 | A1 | 5/2004 | Hirotsu | |

(Continued)

FOREIGN PATENT DOCUMENTS

| | | | |
|---|---|---|---|
| EP | 1 295 711 | A1 | 3/2003 |
| EP | 1 873 071 | A1 | 1/2008 |

(Continued)

OTHER PUBLICATIONS

Pieters, Rik et al., "The Stopping Power of Advertising: Measures and Effects of Visual Complexity," Journal of Marketing, vol. 74, No. 5, Sep. 1, 2010, pp. 48-60.

(Continued)

*Primary Examiner* — Jacob K Ackun
(74) *Attorney, Agent, or Firm* — Kimberly-Clark Worldwide, Inc.

(57) ABSTRACT

A package includes an outer structure having at least one display face. The display face has a framing region and a focal region. The framing region has a framing pattern having a framing pattern complexity value and the focal region has a focal pattern having a focal pattern complexity value. The difference between the framing pattern complexity value and the focal pattern complexity value is at least 3.

20 Claims, 8 Drawing Sheets

(56) References Cited

U.S. PATENT DOCUMENTS

| | | | | |
|---|---|---|---|---|
| 2005/0145523 | A1 | 7/2005 | Zander et al. | |
| 2005/0154365 | A1 | 7/2005 | Zander et al. | |
| 2006/0025739 | A1 | 2/2006 | DiPalma et al. | |
| 2006/0091036 | A1* | 5/2006 | Casella | 206/457 |
| 2007/0032768 | A1 | 2/2007 | Cohen et al. | |
| 2007/0235263 | A1 | 10/2007 | Legault et al. | |
| 2007/0251851 | A1 | 11/2007 | Warren et al. | |
| 2007/0267322 | A1 | 11/2007 | Kishida et al. | |
| 2008/0097364 | A1 | 4/2008 | Yang | |
| 2009/0084698 | A1 | 4/2009 | Ito et al. | |
| 2010/0147721 | A1 | 6/2010 | Molina et al. | |
| 2010/0195916 | A1* | 8/2010 | Blondiaux et al. | 382/209 |
| 2011/0120897 | A1* | 5/2011 | Takahashi | 206/459.5 |
| 2011/0270208 | A1 | 11/2011 | Miura et al. | |
| 2012/0310201 | A1* | 12/2012 | Oates | 604/385.02 |
| 2013/0190711 | A1 | 7/2013 | Hashino et al. | |
| 2013/0220860 | A1* | 8/2013 | Bacon et al. | 206/457 |

FOREIGN PATENT DOCUMENTS

| | | | |
|---|---|---|---|
| EP | 1 994 917 | A1 | 11/2008 |
| EP | 1 994 918 | A1 | 11/2008 |
| EP | 1 828 011 | B1 | 10/2009 |
| EP | 2 219 580 | A2 | 8/2010 |
| EP | 1 833 444 | B1 | 12/2010 |
| WO | WO 02/30347 | A1 | 4/2002 |

OTHER PUBLICATIONS

Co-pending U.S. Appl. No. 29/393,396, filed Jun. 3, 2011, by Oates et al. for "Feminine Care Package."

Co-pending U.S. Appl. No. 13/152,493, filed Jun. 3, 2011, by Oates et al. for "Absorbent Article with Contrasting Wrapper Graphics."

* cited by examiner

PACKAGE WITH CONTRASTING GRAPHICS

BACKGROUND OF THE INVENTION

Packaging for consumer products often serves multiple purposes. For example, the packaging may describe the product located within the packaging, communicate the manufacturer of the product, and provide a convenient method for transporting multiple products. Additionally, packaging may provide navigational cues to assist consumers in finding their products quickly and easily.

Packaging may also provide some discretion to consumers. This is particularly desirable with feminine hygiene articles, incontinence articles, and the like where discretion is prized. For example, when consumers have personally sensitive conditions like incontinence, they may have a heightened need to keep the condition private and discreet. This need for privacy and discretion extends beyond the product to the packaging and to the merchandizing of the product.

However, despite this need for discretion, most packaging for personal care articles is easily recognized because of the familiar shape, color, and look of the packaging. Often there is a tension between the need for discretion and the desire to attract the consumer's attention to the product and the desire to assist the consumer in selecting the proper product type and size. In other words, the need for discretion must be weighed against the need for easy consumer navigation. Some past efforts to address this balance have included a strong focus on the navigational aspects through the use of simple and bold graphics at the expense of discretion. A second approach has focused on concealment by attempting to blend the packaging materials into the surroundings through simple camouflage (i.e., similar print patterns). However, this approach may make navigation more challenging. The third general approach has been the use of transformable packaging wherein the identifying navigation features are prominent on the shelf but are later obscured or removed through various means such as physical removal of the navigation panel. However, this approach may be more costly and may be inconvenient to the consumer. Thus, there still exists a need for packaging that disguises the look of the packaging and reduces the prominence of the navigation panel while still allowing the consumers of these products to efficiently navigate the category.

SUMMARY OF THE INVENTION

In one aspect, the present invention provides a package having an outer structure having at least one display face. The display face has a framing region and a focal region. The framing region has a framing pattern having a framing pattern complexity value. The focal region has a focal pattern having a focal pattern complexity value. The difference between the framing pattern complexity value and the focal pattern complexity value is at least 3.

In some embodiments, the difference between the framing pattern complexity value and the focal pattern complexity value is at least 5 or at least 10.

In some embodiments, the focal region has a background color having a lowest L* value and the framing region has a background color having a lowest L* value. The lowest L* value for the background color of the focal region is at least 10 less than the lowest L* value for the background color of the framing region.

In some embodiments, the package includes a navigation panel wherein the navigation panel is integral with the focal region. In some embodiments, the navigation panel does not have a printed pattern. In some embodiments, the navigation panel is completely surrounded by the focal region.

In some embodiments the package includes a brand graphic located within the focal region.

In some embodiments, the framing pattern complexity value is less than 2. In some embodiments, the focal pattern complexity value is at least 10.

In various embodiments, the framing region is divided into a first framing region and a second framing region. In these embodiments, the focal region completely separates the first framing region from the second framing region on the display face.

In another aspect, the present invention provides a package having an outer structure having at least one display face. The display face has a first framing region, a second framing region, and a focal region. The focal region completely separates the first framing region from the second framing region on the display face. The first framing region has a first printed pattern having a first pattern complexity value. The second framing region has a second printed pattern having a second complexity value. The focal region has a focal printed pattern having a focal complexity value. The difference between the first pattern complexity value and the focal complexity value is at least 3 and the difference between the second pattern complexity value and the focal complexity value is at least 3.

In some embodiments, the difference between the first pattern complexity value and the second pattern complexity value is less than 1.

In some embodiments, the focal region has a background color having a lowest L* value. The first framing region has a first background color having a lowest L* value. The second framing region has a second background color having a lowest L* value. The lowest L* value for the background color of the focal region is at least 10 less than the lowest L* value for the first background color of the first framing region and the lowest L* value for the second background color of the second framing region.

In some embodiments, the display face includes a navigation panel. The navigation panel defines a navigation panel area. A majority of the navigation panel area is located within the focal region.

In some embodiments, the navigation panel includes a printed pattern having a pattern complexity value of at least 2 more than the pattern complexity value of the focal pattern.

In some embodiments, the focal region has a background color having a lowest L* value, the first framing region has a first background color having a lowest L* value, the second framing region has a second background color having a lowest L* value, and the navigation panel has a navigation background color having a lowest L* value. In these embodiments, the lowest L* value for the background color of the focal region is at least 10 less than the lowest L* value for the background color of the first framing region and the second framing region. The lowest L* value for the background color of the focal region is at least 10 less than the lowest L* value for the background color of the navigation panel.

In another aspect, the present invention provides a merchandizing system. The merchandizing system includes a first product having a first product form and a first performance characteristic. The merchandizing system also includes a second product having a second product form and a second performance characteristic. The first product form is different than the second product form or the first performance characteristic is different than the second performance characteristic. The first product is contained in a first package having an outer structure having at least one display face. The display face has a framing region and a focal region. The framing region has a framing pattern having a framing pattern complexity value. The focal region has a focal pattern having a focal pattern complexity value. The difference between the framing pattern complexity value and the focal pattern complexity value is at least 3. The second product is contained in a second package having an outer structure having at least one display face. The display face has a framing region and a focal region. The framing region has a framing pattern having a framing pattern complexity value. The focal region has a focal pattern having a focal pattern complexity value. The difference between the framing pattern complexity value and the focal pattern complexity value is at least 3.

In some embodiments, the first product form is an incontinence pad and the first product performance characteristic is a first absorbency and the second product form is an incontinence pad and the second product performance characteristic is a second absorbency. The first absorbency and the second absorbency are different.

In some embodiments, the merchandizing system further includes a display structure. The display structure has an outer structure having at least one display face. The display face has a framing region and a focal region. The framing region has a framing pattern having a framing pattern complexity value. The focal region has a focal pattern having a focal pattern complexity value. The difference between the framing pattern complexity value and the focal pattern complexity value is at least 3.

DEFINITIONS

Figure 1:
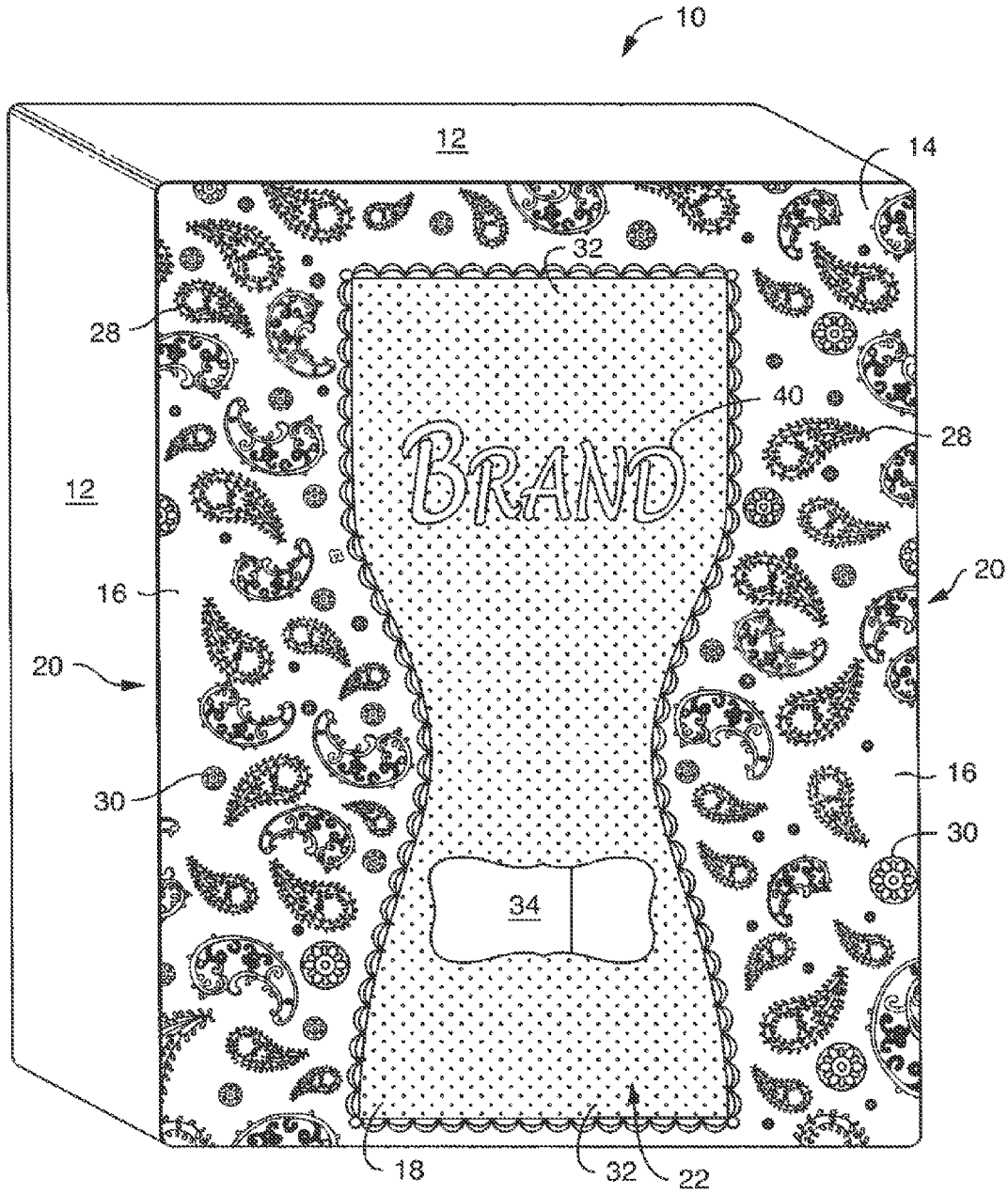
FIG. 1 representatively illustrates a perspective view of a first exemplary package of the present invention.

As used herein, the term "article" or "article component" is used to describe an item which is to be used by a consumer. For example, absorbent articles include without limitation diapers, pull-up type training pant garments, adult incontinence garments, male incontinence products, tampons, vaginal suppositories, pantiliners, female incontinence pads, and sanitary napkins, which are sometime referred to as "personal care articles" or "absorbent personal care articles". For the purposes of this patent, a separate or individual peel strip which protects the adhesive is considered to be a part of the article. If the peel strip also serves as a wrapper, then the peel strip/wrapper is considered as a packaging component.

As used herein, the term "packaging" or "packaging component" is used to describe any items which are associated with the article, but not used within the absorbency purpose of the article. Packaging can be any items which are used to transport, store, protect or hide the article. Examples of packaging include, without limitation, wrappers, pouches, bags, boxes and the like. Typically, boxes or bags are placed on store shelves. Generally, these boxes or bags contain a plurality of absorbent personal care articles. These items may be referred to as an "outer packaging component". In addition, packaging may include an inner wrapper or pouch in which the one or more absorbent personal care articles are placed. Wrappers and pouches may be referred to as an "inner packaging component". These wrapper or pouches can be placed into a second packaging component, such as the outer packaging described above.

As used herein, the term "color" is intended to mean an individual's perception of the spectral composition of visible light coming from a portion of an object. Color characteristics include hue, saturation and luminosity. Each is a separate color characteristic. Hue is the attribute of a color which allows it to be classified as a given color. Saturation, which is sometimes referred to as vividness, is the intensity of the color. Saturation is the degree of freedom from gray. Luminosity, sometimes referred to as value, is the degree of lightness (paleness) or darkness in a color. For example, a blue with white added is a pale color, e.g. baby blue and blue with black added is a dark color, e.g. navy blue.

As used herein, the term "form" is used to describe an individual's perception of the spatial variation of visible light due to the bulk shape and structure of a portion of an object in three dimensions. Stated another way, form is shape and structure of an item which distinguishes it from its surrounding which causes a spatially discontinuous change in light that is transmitted through or reflected from an item.

As used herein, the term "pattern" is used to describe the individual's perception of spatial variation of visible light due to contrasts in spatial variation of light due to the color, form, and texture of a portion of an object incorporated into the object by the manufactory of the elements. This contrast creates various visual distinct regions or lines sometimes referred to as "figures" within its surrounding sometimes referred to as "ground." Patterns can be formed by combinations of contrasting color, form, and texture relative to its surroundings or background. For a pattern to be visually perceptible from its background it needs to be visible.

As used herein, the term "visible" is intended to mean an attribute or a feature which is visually perceived by an individual user or consumer. Generally for a consumer or user, the attribute should be visible in the range of about 0.25 feet (0.075 meters) to about 3 feet (0.91 meters). For a non-consumer or non-user, generally for an attribute to be visible, the distance should be greater than about 3 feet (0.91 meters). As used herein, "perceived" or "perception" is the ability to recognize an attribute or feature when the visual angle that the attribute or feature subtends is greater than about 5 minutes of visual arc and less than about 45 minutes of visual arc as determined by the following equation:

$$\text{Minutes of visual arc} = 3438 * (\text{length of the object} / \text{distance from object})$$

Where

Length of the object=size of the object measured perpendicular to the line of sight Distance from object=distance from the front of the eye to the object along the line of sight A minute of visual arc is $\{\text{fraction } (1/60)\}^{th}$ of 1 degree.

DETAILED DESCRIPTION OF THE DRAWINGS

The present invention provides packaging for use with any suitable products. For example, the present invention provides packaging for absorbent articles such as baby diapers, training pants, feminine hygiene products, and the like. In a specific embodiment, the present invention provides packaging for use with feminine incontinence articles. The present invention also provides packaging graphics that make navigation easier by selectively incorporating contrasting packaging graphics. As used herein, the term "contrast" means to differ in pattern complexity value, the number of colors, and/or the color intensity.

Referring now to FIG. 1, an exemplary package 10 is representatively illustrated. The package 10 includes an outer structure 12 having at least one display face 14. In general, the display face 14 is the side of the package 10 oriented towards the consumer as the package 10 is displayed on the retail shelf. Thus, consumers will generally be viewing the display face 14 when selecting products in the retail environment. However, in various embodiments, one or more additional surfaces of the package 10 may be alternately or additionally adapted to be a display face.

In various embodiments, the outer structure of the various packages may be made of any suitable material or combination of materials. For example, in some embodiments, the outer structure may be a polyolefin film, a nonwoven material, cardstock, paperboard, and the like and combinations thereof. In some embodiments the outer structure may include one or more openings wherein the contents of the package may be visible from the outside of the package. For example, the outer structure may include one or more windows in one or more sides of the package. In various embodiments, the package may have any suitable number of sides and may be formed in any suitable shape. For example, the package may include six sides and be formed in the shape of a hexahedron as illustrated herein.

The display face 14 includes a framing region 16 and a focal region 18. The framing region 16 has a framing pattern 20 printed therein. The framing pattern 20 defines a framing pattern complexity value. Likewise, the focal region 18 includes a focal pattern 22 printed therein. The focal pattern 22 defines a focal pattern complexity value. In general, a printed pattern is visibly perceptibly different as compared to the background color. In preferred embodiments, the framing pattern is more complex than the focal pattern. Thus, the framing region is visually more complex than the focal region.

While not wishing to be bound by theory, it is believed that the visually complex framing region highlights or draws the attention of the consumer to the simpler focal region like a picture frame to a picture. It is further believed that the contrast in complexity between the framing region and the focal region helps quickly draw the consumer's eye to the focal region which is usually near the center of the package. While other methods of attracting the consumer's attention have been tried, it is believed that the design complexity of the framing region draws the consumer's attention to the package and the simpler focal region focuses attention on the key customer communications such as branding and navigation.

The complexity of a given graphic can be determined by using the Pattern Complexity Value (PCV or complexity value) measurement method described herein. Generally, the Pattern Complexity Value (PCV) method determines a numeric value of complexity for a printed graphic pattern via a combination of specific image analysis measurement parameters. The PCV method is performed using conventional optical image analysis techniques to detect graphic patterns and measure the complexity of the graphic patterns when viewed using a camera with incident lighting. An image analysis system controlled by an algorithm detects and measures several of the dimensional properties of the graphic pattern. The resulting dimensional measurement data are combined to calculate the PCV of a given pattern.

Figure 2:
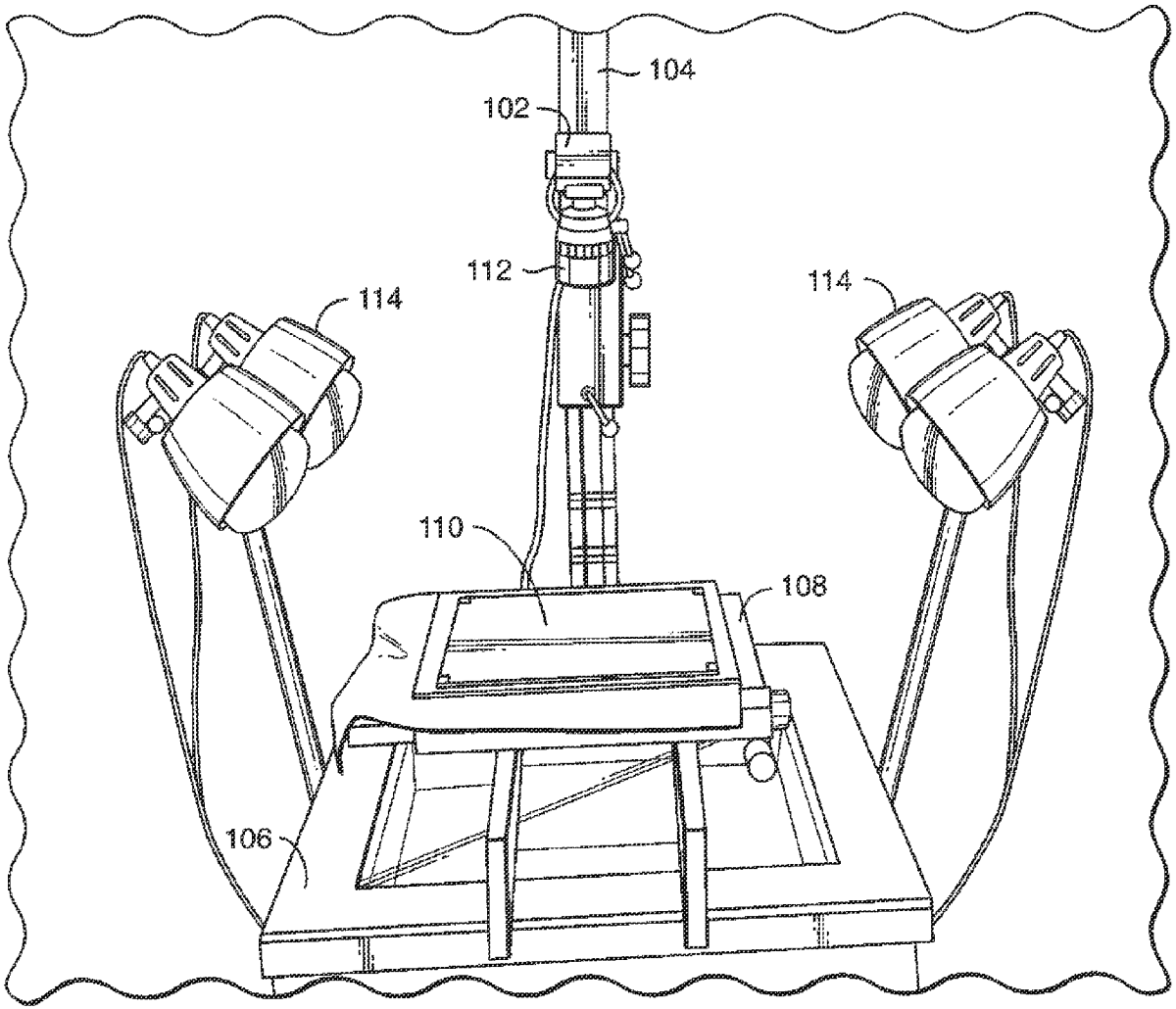
FIG. 2 is a schematic illustration of exemplary apparatus set up to measure Pattern Complexity Values.

The method for determining the PCV of a given sample includes the step of acquiring the image of the sample. An exemplary setup for acquiring the image is representatively illustrated in FIG. 2. Specifically, a CCD video camera 102 (e.g., a Leica DFC 310 FX video camera available from Leica Microsystems of Heerbrugg, Switzerland) is mounted on a standard support 104 such as a Polaroid MP-4 Land Camera standard support available from Polaroid Resource Center in Cambridge, Miss. The standard support 104 is attached to a macro-viewer 106 such as a KREONITE macro-viewer available from Kreonite, Inc., having an office in Wichita, Kans. An auto stage 108 is placed on the upper surface of the macro-viewer 106. The auto stage 108 is used to move and adjust the position, via a joystick, of a given sample 110 for optimal viewing by the camera 102. A suitable auto stage is Model H112, available from Prior Scientific Inc., having an office in Rockland, Mass.

The sample 110 possessing a printed graphic design is placed on the auto stage 108 of a Leica Microsystems QWIN Pro Image Analysis system, under the optical axis of a 20 mm Nikon AF Nikkon lens 112 with an f-stop setting of 4. The Nikon lens 112 is attached to the Leica DFC 310 FX camera 102 using a c-mount adaptor. The distance from the front face of the Nikon lens 112 to the sample 110 is approximately 43 cm. The sample 110 is flattened and any wrinkles removed by covering it with a transparent glass plate and/or fastening it to the auto stage 108 surface using transparent adhesive tape at its outer edges. The sample 110 is illuminated with incident incandescent lighting using four, 150 watt, GE Reflector Flood lamps 114. The lamps 114 are attached to the KREONITE macro-viewer 106. The illumination level of the lamps is controlled with a POWERSTAT Variable Auto-transformer, type 3PN117C, available from Superior Electric, Co. having an office in Bristol, Conn.

The image analysis software platform used to acquire images and perform the dimensional measurements is a QWIN Pro (Version 3.5.1) available from Leica Microsystems, having an office in Heerbrugg, Switzerland. Prior to executing the algorithm below, the method for determining the PCV includes the step of shading correction. Additionally, if the sample includes colored graphics then color white balancing is undertaken and three command lines in the algorithm below (denoted with superscript $^{rr}$) are changed to reflect color imaging in either red-green-blue (RGB) or hue-saturation-intensity (HSI) color space. Both the shading correction and the white balancing steps are performed using the QWIN software and a flat white background (e.g., a photographic positive from Polaroid 803 film) being illuminated by the flood lamps. The system and images are also accurately calibrated using the QWIN software and a standard ruler with metric markings at least as small as one a millimeter. The calibration is performed in the horizontal dimension of the video camera image.

Thus, the method for determining the PCV of a given sample also includes the step of performing the dimensional measurements. Specifically, an image analysis algorithm is used to acquire and process images as well as perform measurements using Quantimet User Interactive Programming System (QUIPS) language. The image analysis algorithm is reproduced below.

```
NAME = Pattern Complexity - 1a
PURPOSE = Measures 'complexity' of Patterns and Elements via various
shape parameters
CONDITIONS = DFC 310 FX; monochrome or color; 20-mm Nikkon
(f/4); 4-floods; white or black back.; cover plate; MP4 pole=69 cm
AUTHOR = D. G. Biggs
Open File ( C:\Data\29993\data.xls, channel #1 )
Open File ( C:\Data\29993\feature data.xls, channel #2 )
REPLICATE = 0
SAMPLE = 0
SET-UP
-- Calvalue = 0.149 mm/px
CALVALUE = 0.149
Calibration ( Local )
Enter Results Header
File Results Header ( channel #1 )
File Line ( channel #1 )
File Line ( channel #1 )
File Results Header ( channel #2 )
File Line ( channel #2 )
File Line ( channel #2 )
Measure frame ( x 31, y 61, Width 1330, Height 978 )
Image frame ( x 0, y 0, Width 1392, Height 1040 )
For ( SAMPLE = 1 to 1, step 1 )
  PauseText ( "Enter object classification (e.g. geo, element, pattern,
  etc.)." )
  Input ( TITLE$ )
  File ( TITLE$, channel #1 )
  File Line ( channel #1 )
  File ( TITLE$, channel #2 )
  File Line ( channel #2 )
  File ( "Object ID", channel #1 )
  File ( "Area", channel #1 )
  File ( "Perimeter", channel #1 )
  File ( "Area Fract.", channel #1 )
  File Line ( channel #1 )
  File ( "Object ID", channel #2 )
  File ( "Area", channel #2 )
  File ( "Conv. Area", channel #2 )
  File ( "Perim.", channel #2 )
  File ( "Conv. Perim.", channel #2 )
  File ( "Number", channel #2 )
  File Line ( channel #2 )
  For ( REPLICATE = 1 to 5, step 1 )
    Image frame ( x 0, y 0, Width 1392, Height 1040 )
    Binary Edit ( Clear Binary2 )
    IMAGE ACQUIRE
    ACQOUTPUT = 0
    Colour Transform ( Mono Mode )#
    PauseText ( "Position sample for imaging." )
    Display ( Image0 (on), frames (on,on), planes (off,off,off,off,off,off),
      lut 0, x 0, y 0, z 1, Reduction off )
    Image Setup DC Twain [PAUSE] ( Camera 1, AutoExposure Off,
      Gain 0.00, ExposureTime 78.43 msec, Brightness 0, Lamp 49.99 )#
    Acquire ( into Image0 )
    ACQFILE$ = "C:\Images\29993 -
    Hopkins\"+TITLE$+"_"+STR$(REPLICATE)+".tif"
    Write image ( from ACQOUTPUT into file ACQFILE$ )
    Display ( Colour0 (on), frames (on,on), planes (off,off,off,off,off,
      off),lut 0, x 0, y 0, z 1, Reduction off )
  DETECTION AND IMAGE PROCESSING
  PauseText ("Adjust detection to include all printed areas. If necessary,
      this line can be changed to HSI or RGB detection thru editing.")
  Detect [PAUSE] ( blacker than 183, from Image0 into Binary0
  delineated )#
  PauseText ( "Is additional/unique image processing required? If yes,
  enter 1." )
  Input ( PROCESS )
  If ( PROCESS=1 )
      PauseText ( "Use Binary Amend to optimize detection. The final
step must output to Binary0." )
      Binary Amend [PAUSE] ( Open from Binary0 to Binary0, cycles 1,
operator Disc, edge erode on )
      PauseText ( "Use Binary Editing to optimize detection. The final
        step must output to Binary0." )
      Binary Edit [PAUSE] ( Reject from Binary0 to Binary0, nib Fill,
      width 2 )
  Else
      Goto CONTINUE
  Endif
```

-continued

```
  CONTINUE:
  Display ( Image0 (on), frames (on,on), planes (0,off,off,off,off,off),
lut 0, x 0, y 0, z 1, Reduction off )
  PauseText ( "Set Measure Frame to encompass features of interest and
image frame to be just inside the measure frame." )
  Measure frame [PAUSE] ( x 31, y 61, Width 1330, Height 978 )
  Image frame [PAUSE] ( x 0, y 0, Width 1392, Height 1040 )
  PauseText ( "If detected regions are within the image frame only,
  click on 'OK.'" )
  Binary Edit [PAUSE] ( Cut from Binary0 to Binary1, nib Fill, width 1 )
  Binary Logical ( C = A AND B : C Binary2, A Binary0, B Binary1 )
  MEASURE FIELD
  MFLDIMAGE = 2
  Measure field ( plane MFLDIMAGE, into FLDRESULTS(5), statistics
      into FLDSTATS(7,5) ) Selected parameters: Area, Perimeter,
      Area Fract
  AREA = FLDRESULTS(1)
  PERIM = FLDRESULTS(4)
  AREAFRACT = FLDRESULTS(5)
  File ( REPLICATE, channel #1, 0 digits after '.' )
  File ( AREA, channel #1, 1 digit after '.' )
  File ( PERIM, channel #1, 1 digit after '.' )
  File ( AREAFRACT, channel #1, 1 digit after '.' )
  File Line ( channel #1 )
  MEASURE FEATURES
  Feature Expression ( UserDef1 ( all features ), title Area/Perim =
PAREA(FTR)/PPERIMETER(FTR) )
  Measure feature ( plane Binary2, 8 ferets, minimum area: 6, grey image:
  Image0 )
    Selected parameters: Area, X FCP, Y FCP, Perimeter, ConvxPerim,
    ConvexArea
  File ( REPLICATE, channel #2, 0 digits after '.' )
  FSAREA = Field Sum of ( PAREA(FTR) )
  File ( FSAREA, channel #2, 1 digit after '.' )
  FSCONVAREA = Field Sum of ( PCONVAREA(FTR) )
  File ( FSCONVAREA, channel #2, 1 digit after '.' )
  FSPERIM = Field Sum of ( PPERIMETER(FTR) )
  File ( FSPERIM, channel #2, 1 digit after '.' )
  FSCONVPERIM = Field Sum of ( PCONVPERIM(FTR) )
  File ( FSCONVPERIM, channel #2, 1 digit after '.' )
  FSNUMBER = Field Sum of ( PACCEPTED(FTR) )
  File ( FSNUMBER, channel #2, 0 digits after '.' )
  File Line ( channel #2 )
  Binary Edit ( Clear Binary2 )
 Next ( REPLICATE )
 File Line ( channel #1 )
 File Line ( channel #2 )
Next ( SAMPLE )
Close File ( channel #1 )
Close File ( channel #2 )
END
```

#Denotes command lines that must be changed to their color equivalent format prior to execution if color imaging and detection will be performed.

The QUIPS algorithm is then executed using the QWIN Pro software platform. The analyst is initially prompted to enter in sample identification information. This is followed by a prompting to enter in a base file name for saving the sample replicate specimen images. An opportunity is then given to set up and position the specimen of interest on the sample stage or platform beneath the camera. For most printed designs, a flat white background is suitable to detect the pattern in either gray-scale or color. In some cases, when the specimen is composed of a polymer film, a black background behind the flattened and unwrinkled specimen is suitable to obtain good detection of the pattern.

The sample is positioned so the longest dimension runs horizontally in the image, and the light illumination level of the four-flood lamps is adjusted using the POWERSTAT Variable Auto-transformer to obtain a white level reading of approximately 0.95. During this process of light adjustment, the QUIPS algorithm automatically displays the current white level value within a small window on the video screen. The algorithm then acquires and saves the image to a designated location—typically on the computer's hard drive. The analyst is then prompted to adjust the detection threshold in order to obtain the optimal detection that is possible. The delineation should be turned 'on' and the detection interactive window gray-scale histogram as well as visual observation should be used to ensure the best detection possible. For most printed designs, detection will be adjusted in 'black' mode in gray-scale or hue-saturation-intensity or red-green-blue mode in color. For polymer film patterns when using a black background, the gray-scale mode will likely need to be switched to 'white' mode.

After detection, the analyst is asked whether additional binary image processing is required to further optimize pattern detection. If the analyst believes additional processing will be beneficial, a value of '1' is entered into the prompting window and the analyst is given two opportunities to optimize the binary detection to match the design to the extent possible. In order to check for detected fit versus the actual pattern, the analyst can toggle the 'control' and 'B' keys on the keyboard simultaneously to turn the overlying binary image on and off. A fit is considered good when the binary image closely matches with the printed pattern with respect to its boundaries and regions within said boundaries. If no additional processing is required, the analyst clicks 'OK' without entering any value into the prompting window. If '1' is entered for additional processing, the first opportunity will be thru a 'Binary Amend' window showing various options such as 'closing' and 'opening.' The analyst can experiment to find a good option by changing the output to binary1 or higher. When a specific processing step(s) have been identified, the analyst must do so in such a way so that the final output is into binary0. The second binary 'edit' processing step allows for a selection of manual interactions (e.g. reject, accept, draw, etc.) with the image to clean it up for the measurement step of the algorithm. Again, the final step within the manually editing processing step must go into binary0 for the output. If no editing is required, the analyst clicks 'OK' and allows the algorithm to proceed.

After the option of additional processing, the algorithm will then prompt the analyst to manually select both measurement and image frame regions of interest (ROI). First, the measurement frame is selected to enclose the detected pattern over as much of the sample (e.g., framing region or focal region) as possible or at least enough to cover one unit cell if there is a pattern that repeats. Secondly, the image frame is selected to be just inside the boundaries of the previously selected measurement frame. The resulting image frame size should be two pixels less wide and long as the measurement frame and located within the measurement frame boundaries.

After the measurement and image frames have been selected, the algorithm will automatically perform measurements and output the data into two different spreadsheets. The first spreadsheet is labeled "data.xls" and is for the field data. The second spreadsheet is labeled "feature data.xls" and is for feature data. The following primary measurement parameter data will be located in the feature data.xls file after measurements and data transfer has occurred:

| |
|---|
| Area |
| Perimeter |
| Convex area |
| Convex perimeter |
| Number of features |

The following primary measurement parameter data will be located in the data.xls file after measurements and data transfer has occurred. The field area and perimeter data located in the data.xls file are not used for calculations and should be within approximately 5% of those in the feature-data.xls file and may be used to collaborate the accuracy of the comparable area and perimeter data located in featuredata.xls file.

| |
|---|
| Area Fraction |
| Area |
| Perimeter |

From these primary measurement parameter data, which are all totals for the selected image frame ROI, a number of secondary derived parameters can be calculated using the following calculations:

Fullness ratio=Sqrt.(area/convex area)

Convexity=convex perimeter/perimeter

Finally, the secondary parameters are combined with area fraction to calculate the PCV parameter:

PCV=(Area/Perimeter×Convexity/Fullness ratio)/Area Fraction

Multiple replicates from a single sample can be performed during a single execution of the QUIPS algorithm. Primary dimensional data will be transferred to the EXCEL spreadsheets for each replicate. Between each replicate, a new sample is placed onto the auto-stage and adjusted via a joystick for image acquisition and analysis. The final sample mean PCV parameter is based on an N=5 analysis from five, separate, product specimen subsamples. A comparison between different samples can be performed using a Student's T analysis at the 90% confidence level.

The Pattern Complexity Value method returns a complexity value for a given graphic wherein the more complex the graphic the lower the complexity value. Likewise, the less complex the graphic the higher the complexity value. In other words, graphics having a lower complexity value are more complex than graphics having a relatively higher complexity value (i.e., the PCV is inversely proportional to the complexity of the graphic).

Figure 3:
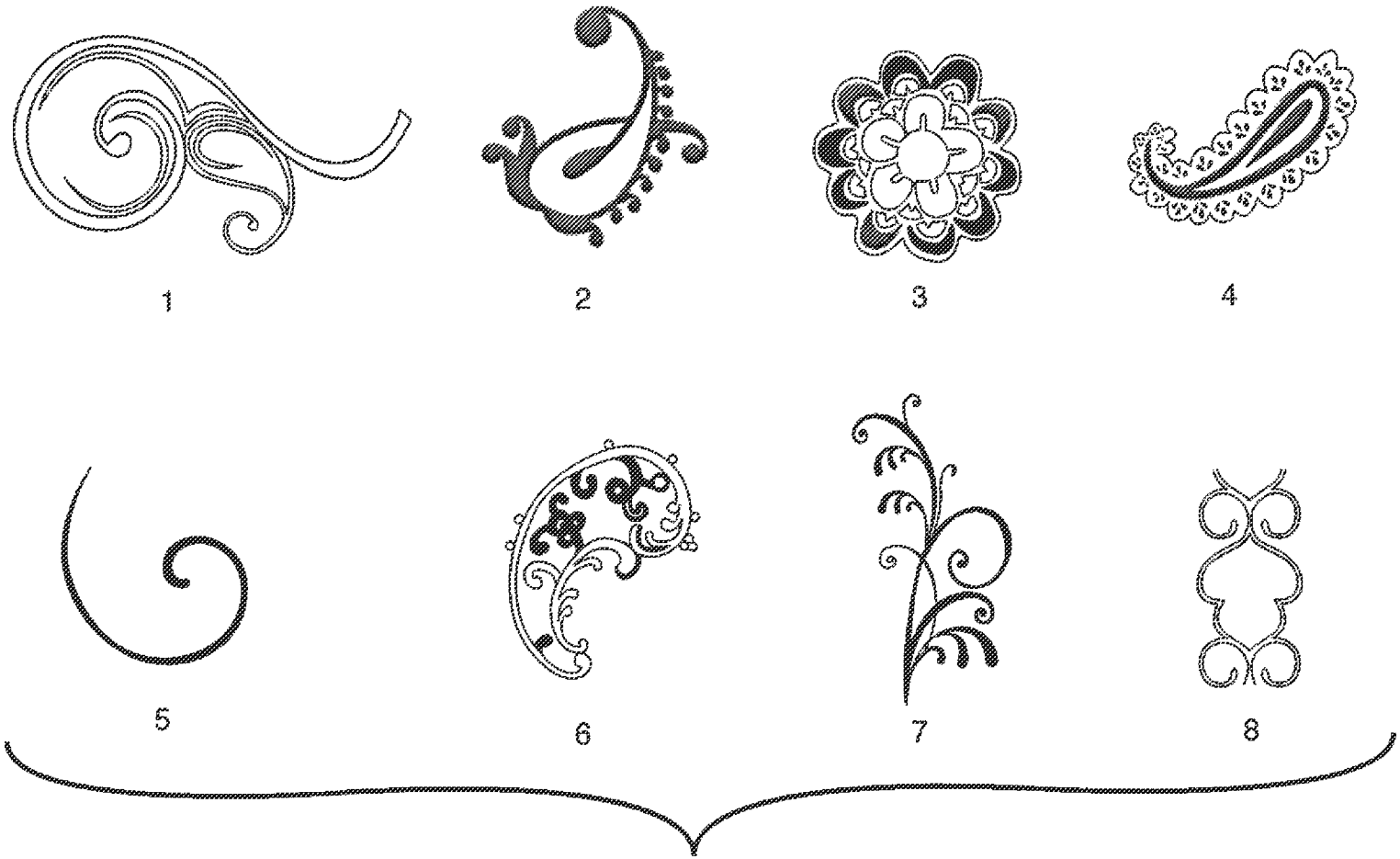
FIG. 3 representatively illustrates exemplary design elements.

To demonstrate the use of the Pattern Complexity Value method, a number of exemplary graphics were measured. Referring now to FIG. 3, the exemplary graphics are representatively illustrated and numbered 1-8. Each graphic 1-8 was measured using the Pattern Complexity Value method and the results are reproduced in Table 1 below. For these measurements, each graphic was enclosed at its outer boundaries with the smallest possible measure and image frame size that could contain the graphic.

TABLE 1

| Graphic # | Complexity Value |
|---|---|
| 1 | 13.6 |
| 2 | 24.1 |
| 3 | 9.6 |
| 4 | 13.3 |
| 5 | 32.1 |
| 6 | 5.2 |
| 7 | 15.7 |
| 8 | 7.5 |

As can be seen from Table 1, the graphics of FIG. 3 can be generally grouped into three categories: most complex (graphics 3, 6, 8), moderately complex (graphics 1, 4, 7), and least complex (graphics 2 and 5).

Referring again to FIG. 1, the framing region 16 representatively illustrates a relatively complex framing pattern 20. The framing pattern 20 includes paisley designs 28 of various shapes and sizes and stylized flowers 30 of different sizes. Likewise, the focal region 18 includes a relatively simple focal pattern 22 of offset dots 32. To determine the PCV difference between the framing pattern 20 and the focal pattern 22, the actual framing pattern 20 was measured at four different locations and the actual focal pattern 22 was measured at four different locations. The results of these measurements are summarized in Table 2 below. It should be noted that the testing was conducted on actual printed packaging and the illustrations of FIG. 1 are representative of the patterns tested.

TABLE 2

| Location | PCV of focal pattern 22 | Location | PCV of framing pattern 20 | Δ PCV |
|---|---|---|---|---|
| 1 | 12.46 | 5 | 0.694 | |
| 2 | 11.89 | 6 | 0.633 | |
| 3 | 13.39 | 7 | 1.023 | |
| 4 | 13.11 | 8 | 0.746 | |
| Mean | 12.71 | Mean | 0.77 | 11.94 |
| S. Dev. | 0.67 | | 0.17 | |
| % RSD | 5.3 | | 22.2 | |

As can been seen in Table 2, the focal pattern 22 had a mean PCV of 12.71. A PCV of 12.71 indicates a relatively low pattern complexity. In comparison, the framing pattern 20 had a mean PCV of 0.77. A PCV of 0.77 indicates a relatively high pattern complexity. Thus, the difference in PCV between the focal pattern 22 and the framing pattern 20 is 11.94. A PCV of 11.94 indicates a relatively large difference in complexity between the two patterns.

In various embodiments, the framing pattern complexity value may be less than 10, less than 9, less than 8, less than 7, less than 6, less than 5, less than 4, less than 3, less than 2, or less than 1. Likewise, the focal pattern complexity value may be least 8, at least 9, at least 10, at least 11, at least 12, at least 13, or at least 14. In some embodiments, the difference between the framing pattern complexity value and the focal pattern complexity value is at least 3, at least 5, at least 7, and at least 10. In various embodiments, the framing pattern complexity value is lower than the focal pattern complexity value. In other words, in some embodiments, the framing pattern is more complex than focal pattern.

Figure 4:
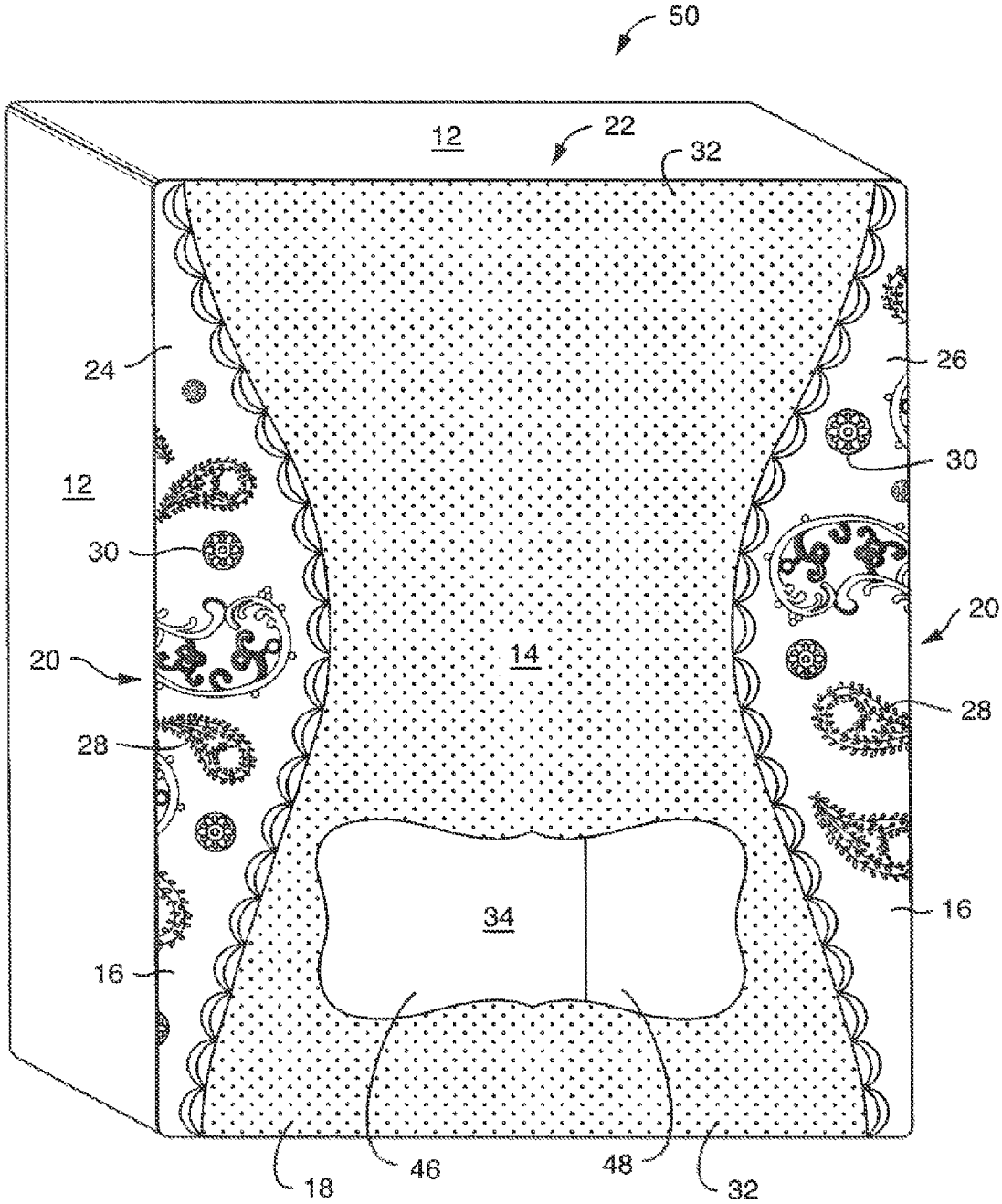
FIG. 4 representatively illustrates a perspective view of a second exemplary package of the present invention.

The package 10 of FIG. 1 includes a framing region 16 and a focal region 18. In this embodiment, the framing region 16 is unitary and surrounds at least three sides of the focal region 18. In comparison, FIG. 4 representatively illustrates another exemplary package 50. The package 50 includes a framing region 16 and a focal region 18. In this embodiment, the framing region 16 is divided into a first framing region 24 and a second framing region 26. In this embodiment, the focal region 18 completely separates the first framing region 24 from the second framing region 26 on the display face 14. In these embodiments, the first framing region 24 has a first printed pattern 42 having a first pattern complexity value, the second framing region 26 has a second printed pattern 44 having a second complexity value, and the focal region 18 has a focal printed pattern 22 having a focal complexity value. In various embodiments, the difference between the first pattern complexity value and the focal complexity value is at least 3 and the difference between the second pattern complexity value and the focal complexity value is at least 3. In various embodiments, the first pattern complexity and the second pattern complexity may be essentially the same. For example, in some embodiments, the difference between the first pattern complexity value and the second pattern complexity value is less than 1. In other embodiments, the difference between the first pattern complexity value and the second pattern complexity value may be greater than 1, greater than 2, or greater than 3. In these embodiments, the first pattern complexity value and the second pattern complexity value are both less than the focal pattern complexity value.

The various regions of the present invention may be defined by any suitable means. For example, the various regions of the present invention may be defined by color, printed borders, physical structure, and the like and combinations thereof. For example, in FIG. 1, the focal region 18 is defined by a printed border. In this case, the printed border is a lace-like pattern extending around the focal region 18. In comparison, the framing region 16 is defined in part by the printed border and in part by the physical structure of the package 10. Specifically, the edges wherein the display face 14 transitions into the side panels, the top panels, and the bottom panels define the outer edges of the framing region 18.

In various embodiments, the framing region may have a framing pattern that extends beyond the display face onto one or more sides of the package. Likewise, the focal region may have a focal pattern that extends beyond the display face onto one or more sides of the package. For example, referring now to FIG. 5, another exemplary package 60 is illustrated. The package 60 includes an outer structure 12 having at least one display face 14. The display face 14 includes a framing region 16 and a focal region 18. The framing region 16 has a framing pattern 20 printed therein. Likewise, the focal region 18 includes a focal pattern 22 printed therein. In this embodiment, the framing pattern 20 includes paisley designs 28 of various shapes and sizes and stylized flowers 30 of different sizes. Likewise, the focal region 18 includes a relatively simple focal pattern 22 of offset dots 32. In this embodiment, the framing pattern 20 extends beyond the display face 14 onto a first side 36 of the package 60. In this embodiment, the framing pattern 20 may also extend onto a second side 38. Likewise, the focal pattern 22 is illustrated as extending beyond the display face 14 onto the second side 38 of the package 60.

Utilizing a different number of printed colors in the framing regions as compared to the focal region is another way of creating visual contrast between the two regions. In various embodiments, the framing patterns 20 may have one, two, three, four, five, or more than five different printed colors. Likewise, the focal pattern 22 may have one, two, three, four, five, or more than five different printed colors. In various embodiments, the number of printed framing pattern colors is different than the number of printed focal pattern colors. For example, in some embodiments, the framing pattern has at least two printed colors whereas the focal pattern has at least one fewer printed colors. In various embodiments, the difference between the number of printed colors in the framing pattern is at least one, at least two, at least three, at least four, or at least five more than the number of printed colors in the focal pattern.

To determine the number of colors in a given graphic or pattern, color images of the given graphic patterns are acquired using the QUIPS algorithm described herein. These images can then be measured for their pattern component L*a*b* color values using a number of software packages. For example, image processing and analysis packages such as Matlab (v.6.5.1, release 13; Mathworks), Adobe Photoshop, and Media Cybernetics Image Pro Plus are all suitable for measuring L*a*b* values of various colored graphics within a given pattern. The L*a*b* value for each color of the pattern can then be used to determine the number of different colors present within the pattern. Two colors are considered different if they are just-noticeably different by a consumer. This difference is sometimes estimated by just-noticeable difference or differential threshold that has been quantified by $\Delta E^*_{ab}$ greater than 2.3 as described in ASTM D2244-09b Standard Practice for Calculation of Color Tolerances and Color Differences from Instrumentally Measured Color Coordinates and the references cited therein. Although this just-noticeable difference is sufficient, a larger difference is preferable because the additional contrast between colors is believed to enhance the perceived complexity of the color graphics.

In various embodiments, the framing pattern 20 is comprised of a first total number of inks and the focal pattern 22 is comprised of a second total number of inks. In some embodiments, the difference between the first total number of inks and the second total number of inks is at least one. In some embodiments, the difference between the first total number of inks and the second total number of inks is at least one, at least two, at least three, at least four, or at least five. In some embodiments, the difference between the first total number of inks and the second total number of inks at least one, at least two, at least three, at least four, or at least five and the second total number of inks is less than the first total number of inks.

Another way of creating visual contrast between the various regions is by utilizing different print colors having different L* values in the framing region 16 as compared to the focal region 18. In various embodiments, the focal region 18 may have a background color. Likewise, the framing region 16 may have a background color. Each background color has an L* value that can be measured by any suitable imaging software program as discussed herein. The L* scale ranges from 0 (black) to 100 (white). The L* values are determined from the perspective of the user. In other words, the background color may be printed on either side of the outer structure 12 but the L* value is measured from the side visible to user. In some embodiments, the background color may be on the inside of the outer structure 12. Thus, the L* value of the background color in these embodiments are determined by measuring through the outer structure material. Using ADOBE Photoshop CS5 Extended software (version 12.0 $_x$64, Lab Mode, CIELAB D50), the difference between the lowest L* value measured for the background color in the framing region 16 and the lowest L* value measured for the background color in the focal region 18 may be at least 5, at least 10, at least 15, or at least 20. In various embodiments, the lowest L* value measured for the background color in the focal region 18 is greater than the lowest L* value measured for the background color in the framing region 16. In some embodiments, the background color in the focal region 18 may have a lowest L* value of no more than 20, 25, 30, 35, 40, 45, or 50. In some embodiments, the background color in the framing region 16 may have a lowest L* value of at least 30, 35, 40, 45, 50, 55, 60, 65, or at least 70. In a specific embodiment, the background color in the framing region 16 may have a lowest L* value of about 32 and the background color of focal region 18 may have a lowest L* value of about 15. In various embodiments, the lowest L* value for the background color of the framing region 16 on the display face 14 may be at least 10, at least 15, or at least 20 higher than the lowest L* value for the background color of the focal region 18 on the display face 14.

Again, while not wishing to be bound by theory, it is believed that the color contrast between the framing region and the focal region highlights or draws the attention of the consumer to focal region. It is further believed that embodiments utilizing a darker background color in the focal region quickly draw the consumer's eye to the focal region which is usually near the center of the package.

In some embodiments, the focal region may include one or more background colors having a color gradation. Specifically, in some embodiments, the color of the focal region may have a lower L* value at the outer edges as compared to the more central area of the region. In specific embodiments, the focal region may have a color gradation near the center of the focal region to further draw the consumer's eye to this location.

Referring again to FIGS. 1, 4, and 5, the packages 10, 50, and/or 60 may include one or more navigation panels 34. In various embodiments, the navigation panel 34 may be completely surrounded by the focal region 18 like illustrated in FIGS. 1, 4, and 5. In some embodiments, the navigation panel 34 is adjacent the focal region 18 like illustrated in FIG. 6. The package 70 of FIG. 6 includes an outer structure 12 having at least one display face 14. The display face 14 includes a framing region 16 and a focal region 18. The framing region 16 has a framing pattern 20 printed therein. Likewise, the focal region 18 includes a focal pattern 22 printed therein. In this embodiment, the framing pattern 20 includes paisley designs 28 of various shapes and sizes and stylized flowers 30 of different sizes. Likewise, the focal region 18 includes a relatively simple focal pattern 22 of offset dots 32. In other embodiments, the navigation panel may be partially surrounded by the focal region (not illustrated).

As used herein, the term "navigation panel" refers to a graphic containing information to assist a consumer in selecting the appropriate size and form of product from an array of different product sizes and forms presented on a retail shelf. In various embodiments, the navigation panel includes a background color. In some embodiments, the navigation panel may include two or more different background colors. In some embodiments, the navigation panel may also include a navigation panel pattern. In these embodiments, the navigation panel pattern may have a navigation pattern complexity value of at least 2 more than the pattern complexity value of the focal pattern.

In some embodiments, the packages of the present invention may further include a product graphic. As used herein, the term "product graphic" refers to a printed image that closely represents a product located within the package. For example in some embodiments, the product may be an incontinence pad having a given shape, color, and/or feature and the product graphic may be a printed image that closely resembles the shape, the color, and/or the feature of the incontinence pad located within the package.

In some embodiments, the product graphic may be located at least partially in the navigation panel. For example, the product graphic may define a product graphic area and the navigation panel may define a navigation panel area. In some embodiments, the product graphic area and the navigation panel area may overlap. In some embodiments, at least 25, at least 30, at least 40, at least 50, at least 60, or at least 70% of the product graphic area overlaps with the navigation panel area.

Again, not wishing to be bound by theory, it is believed that locating the navigation panel within or adjacent to the focal region assists consumers in quickly finding the navigation information contained therein. Specifically, the contrasting regions are believed to draw attention to the focal region.

Since the navigation panel is located within the focal region or is adjacent the focal region the consumer is believed to locate the navigation panel more readily.

Figure 5:
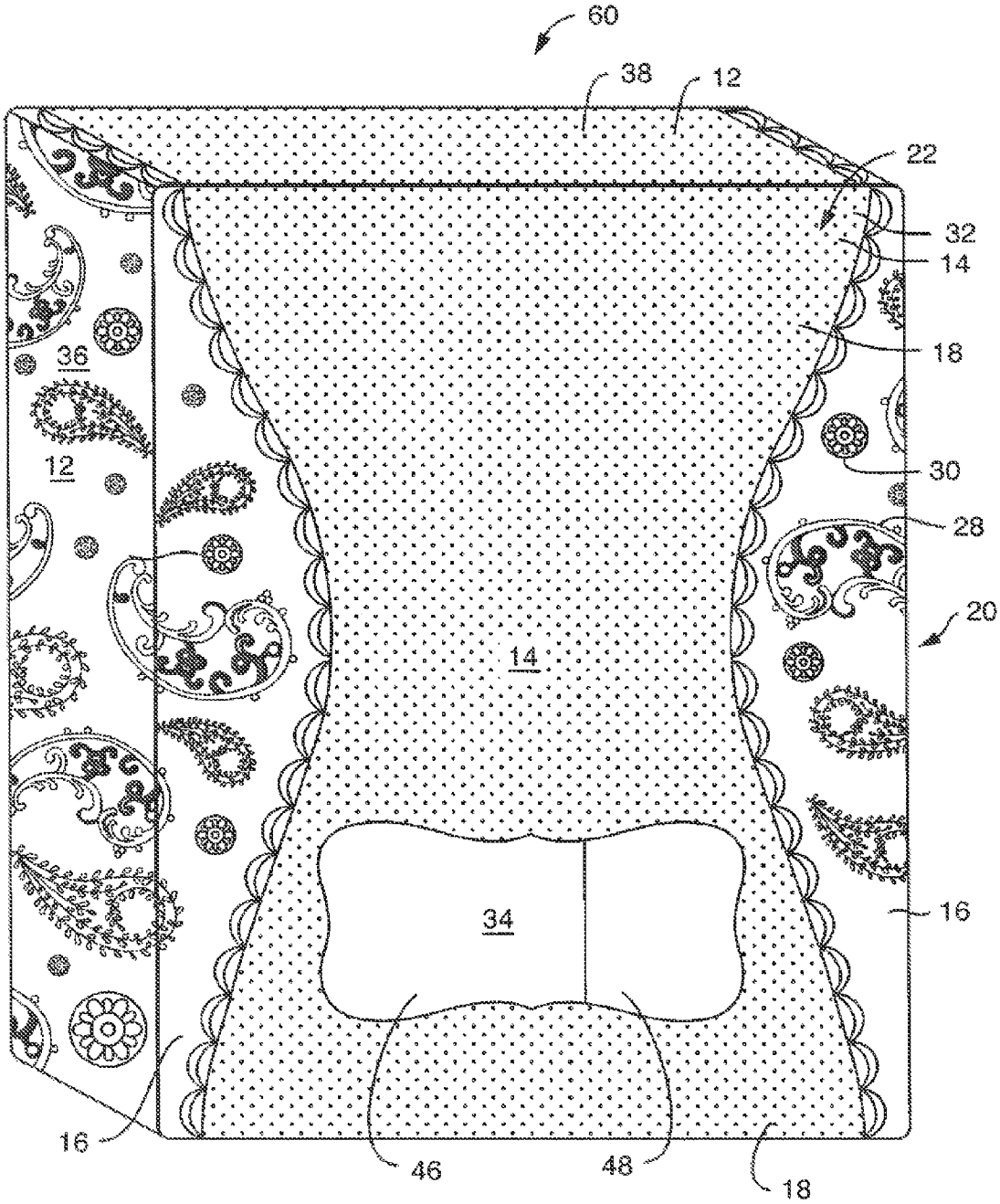
FIG. 5 representatively illustrates a perspective view of a third exemplary package of the present invention.
Figure 6:
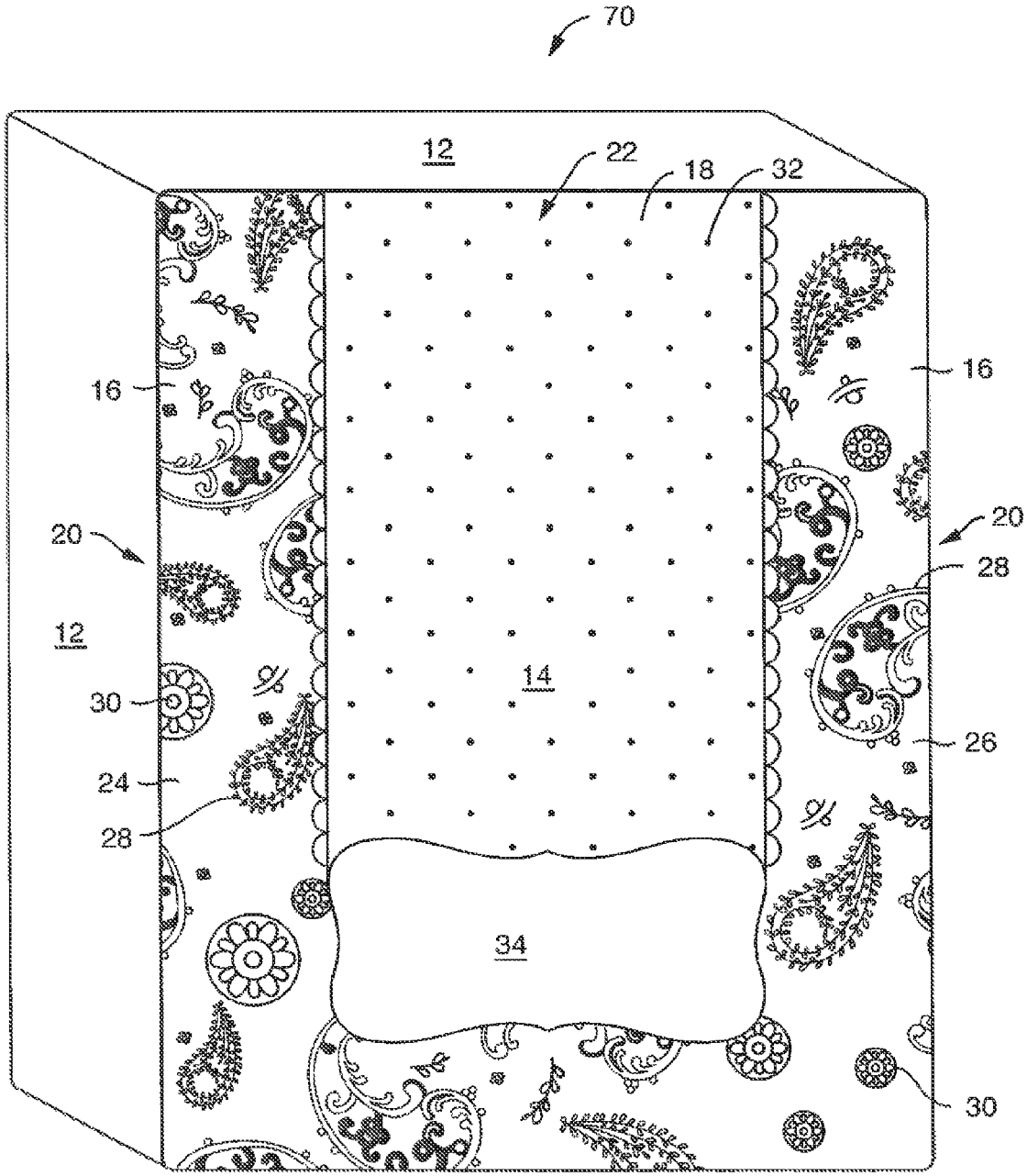
FIG. 6 representatively illustrates a perspective view of a fourth exemplary package of the present invention.

Another way of creating color contrast is by utilizing different print colors having different L* values in the navigation panel 34 as compared to the framing region 16 and/or the focal region 18. In various embodiments, the navigation panel 34 may have one or more background colors. In some embodiments, the navigation panel 34 may be split into a first portion 46 and a second portion 48 as illustrated in FIGS. 4 and 5. In these embodiments, the first portion 46 has a background color and the second portion 48 has a background color. In various embodiments, the background color of the first portion 46 may be the same or may be different than the background color of the second portion 48. Again, using ADOBE Photoshop CS5 Extended software (version 12.0 $_x$64, Lab Mode, CIELAB D50), the lowest L* value was measured for the background color in the first portion 46 and the second portion 48 in exemplary navigation panels 34. In one embodiment, the lowest L* value for the background color in the first portion 46 is about 13 while the lowest L* value for the background color in the second portion 48 is about 61. In another embodiment, the lowest L* value for the background color in the first portion 46 is about 25 while the lowest L* value for the background color in the second portion 48 is about 61. In another embodiment, the lowest L* value for the background color in the first portion 46 is about 58 while the lowest L* value for the background color in the second portion 48 is about 61. In some embodiments, the lowest L* value of the background color of the navigation panel 34 may be greater than the lowest L* value of the background color of the focal region 18.

Referring again to FIG. 1, in various embodiments, the packages of the present invention may further include a brand graphic 40. The brand graphic 40 is generally composed of text indicating the source of manufacturing of the product contained with the packages. The brand graphic is not considered part of the focal pattern 22 or the framing pattern 20. In various embodiments, the brand graphic 40 may be located on the display face 14 in any suitable location. For example, in some embodiments, the brand graphic 40 may be located within the focal region 18 as illustrated in FIG. 1. In other embodiments, the brand graphic may be located within the framing region (not shown) or may be at least partially located in both the framing region and the focal region (not shown).

In some aspects, the present invention also includes a merchandizing system. Any of the packages and/or products disclosed herein are suitable for use in the merchandizing system. For example, referring now to FIG. 7, an exemplary merchandizing system 100 is representatively illustrated. The merchandizing system 100 includes a first product 110 and a second product 210. The first product 110 has a first product form and a first performance characteristic. Likewise, the second product 210 has a second product form and a second performance characteristic. As used herein, the term "product form" refers to different types of products. For example, different product forms include feminine hygiene pads, pantiliners, applicator tampons, digital tampons, incontinence pads, baby diapers, wipes, training pants, and the like. Also as used herein, the term "performance characteristic" refers to measurable attributes of the various products such as absorbency, intake rate, thickness, basis weight, and the like.

In some embodiments, the first product form is different than the second product form. In some embodiments, the first performance characteristic is different than the second performance characteristic. For example, in some embodiments, the first product 110 may be an absorbent pad for bladder incontinence having a first absorbency and the second product 210 may be another absorbent pad for bladder incontinence having a second absorbency that is greater than the first absorbency. In this embodiment, the first product 110 would be the same product form as the second product 210 but would have a different performance characteristic.

In another example, the first product 110 may be an absorbent pad for bladder incontinence and the second product 210 may be a wipe for personal cleansing. In this embodiment, the first product 110 is a different product form than the second product 210. As such, at least some of the performance characteristics are also different.

In the merchandizing system 100, the first product 110 is contained in a first package 101. The first package 101 has an outer structure 112 having at least one display face 114. The display face 114 includes a framing region 116 and a focal region 118. The framing region 116 has a framing pattern 120 having a framing pattern complexity value. Likewise, the focal region 118 has a focal pattern 122 having a focal pattern complexity value. The difference between the framing pattern complexity value and the focal pattern complexity value is at least 3.

In the merchandizing system 100, the second product 210 is contained in a second package 201. The second package 201 has an outer structure 212 having at least one display face 214. The display face 214 includes a framing region 216 and a focal region 218. The framing region 216 has a framing pattern 220 having a framing pattern complexity value. Likewise, the focal region 218 has a focal pattern 222 having a focal pattern complexity value. The difference between the framing pattern complexity value and the focal pattern complexity value is at least 3.

Figure 7:
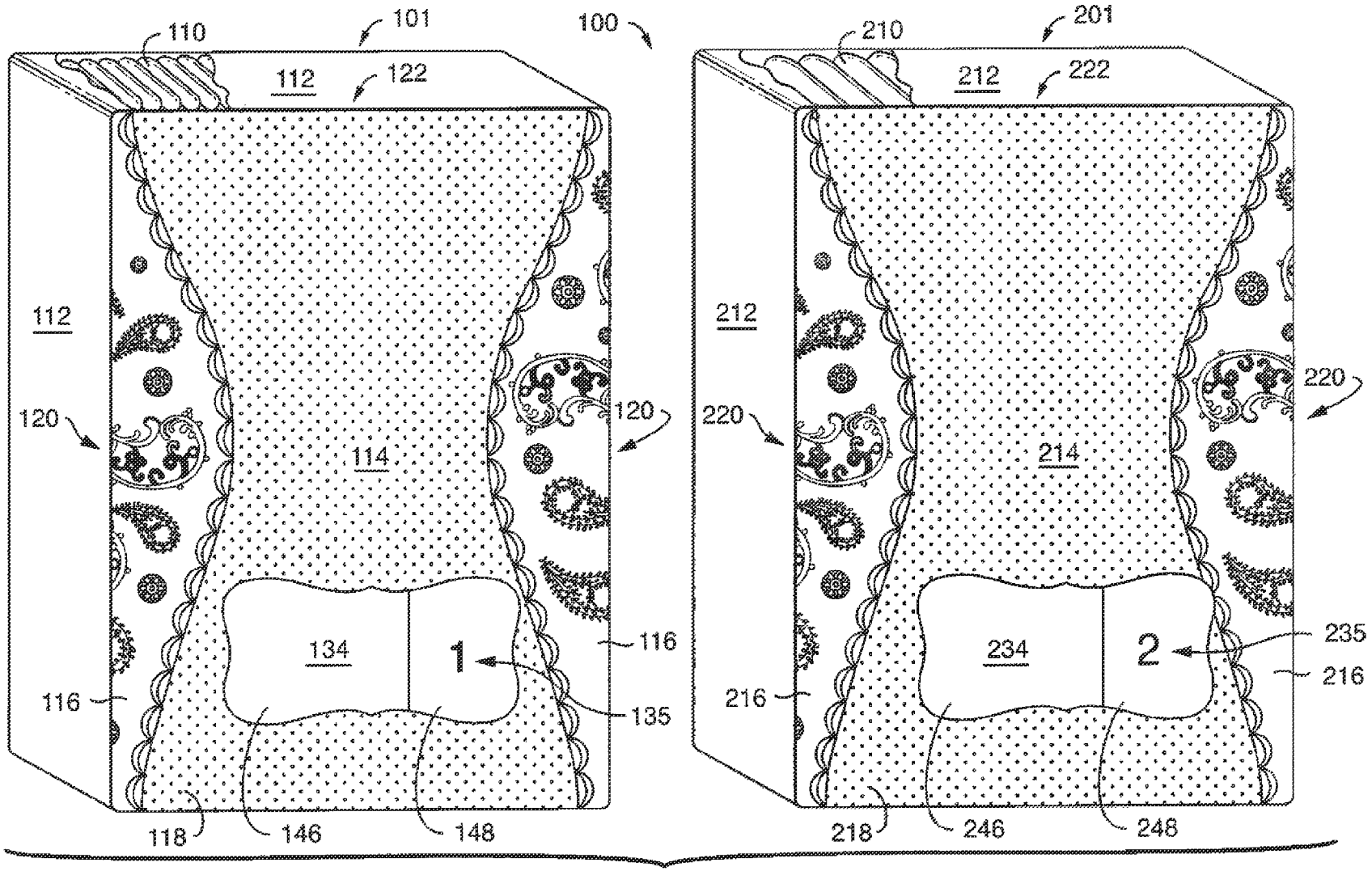
FIG. 7 representatively illustrates an exemplary merchandizing system of the present invention.

The first package 101 also includes a first navigation panel 134. Likewise, the second package 201 also includes a second navigation panel 234. In some embodiments, the navigation panels 134 and 234 may also include performance characteristic indicia or product form indicia. These indicia form part of the navigation panel information useful for directing consumers to the desired product form and/or performance characteristic. For example, as illustrated in FIG. 7, a performance characteristic indicia 135 and/or 235 form part of the navigation panel information. In this embodiment, the first product 110 has first indicia 135 indicating a first absorbency. Likewise, the second product 210 has second indicia 235 indicating a second absorbency different than the first absorbency.

Figure 8:
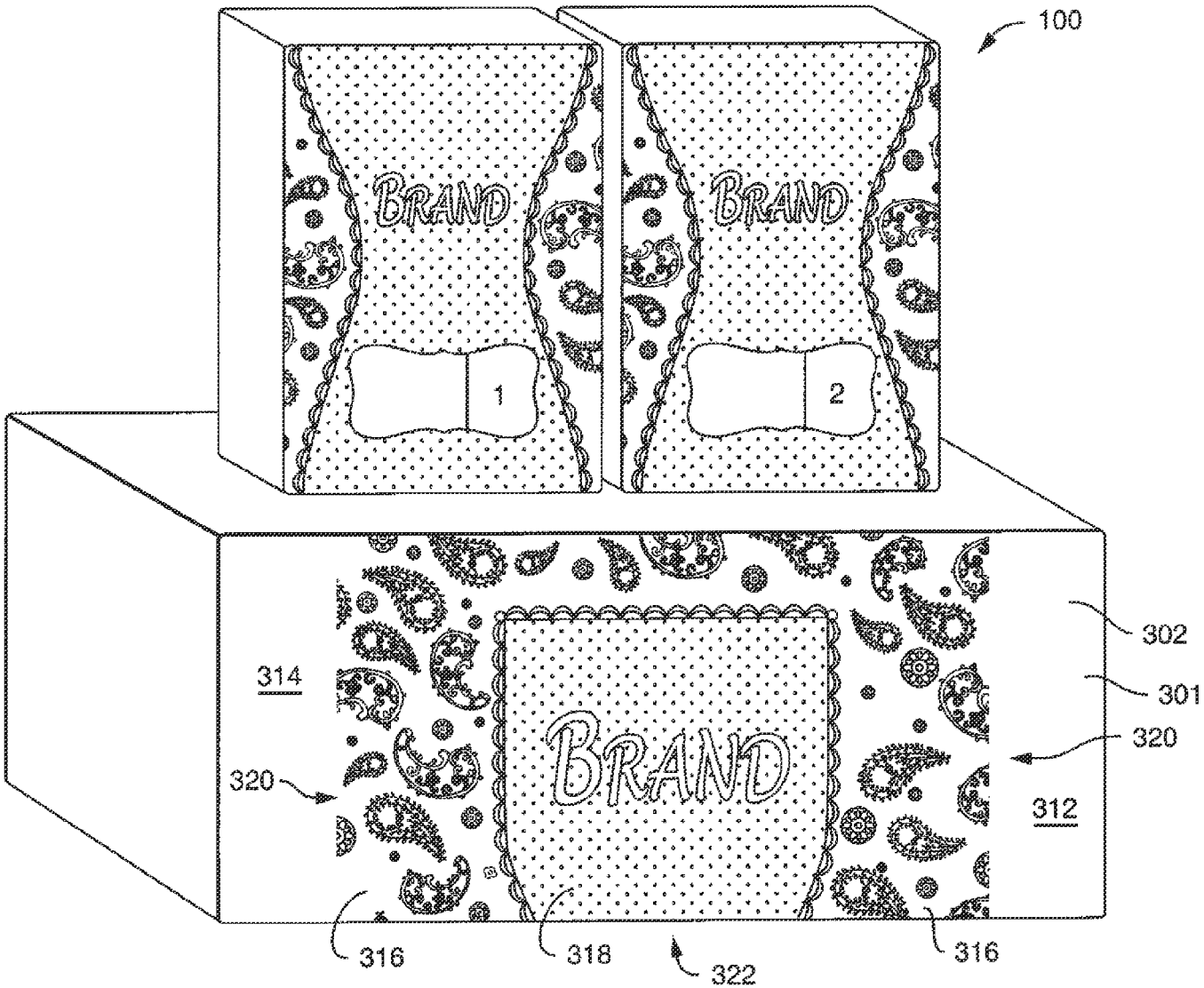
FIG. 8 representatively illustrates a second exemplary merchandizing system of the present invention.

In some embodiments, the merchandizing system 100 further includes a merchandizing medium 301. For example, referring now to FIG. 8, an exemplary merchandizing medium is representatively illustrated as a display structure 302. The display structure 302 has an outer structure 312 having at least one display face 314. The display face 314 includes a framing region 316 and a focal region 318. The framing region 316 has a framing pattern 320 having a framing pattern complexity value. Likewise, the focal region 318 has a focal pattern 322 having a focal pattern complexity value. The difference between the framing pattern complexity value and the focal pattern complexity value is at least 3. In various embodiments, the merchandizing medium 301 may be an in-store display, point-of-sale display, a shelf set, and end cap display, and the like, and combinations thereof.

While the invention has been described in detail with respect to specific embodiments thereof, it will be appreciated that those skilled in the art, upon attaining understanding of the foregoing will readily appreciate alterations to, variations of, and equivalents to these embodiments. Accordingly, the scope of the present invention should be assessed as that of the appended claims and any equivalents thereto. Additionally, all combinations and/or sub-combinations of the disclosed embodiments, ranges, examples, and alternatives are also contemplated.

The invention claimed is:

1. A package comprising an outer structure having at least one display face, the display face having a framing region and a focal region wherein the framing region has a framing pattern having a framing pattern complexity value and the focal region has a focal pattern having a focal pattern complexity value wherein the difference between the framing pattern complexity value and the focal pattern complexity value is at least 3.

2. The package of claim 1 wherein the difference between the framing pattern complexity value and the focal pattern complexity value is at least 5.

3. The package of claim 1 wherein the difference between the framing pattern complexity value and the focal pattern complexity value is at least 10.

4. The package of claim 1 wherein the focal region has a background color having a lowest L* value and the framing region has a background color having a lowest L* value, wherein the lowest L* value for the background color of the focal region is at least 10 less than the lowest L* value for the background color of the framing region.

5. The package of claim 1 further comprising a navigation panel wherein the navigation panel is integral with the focal region.

6. The package of claim 5 wherein the navigation panel does not have a printed pattern.

7. The package of claim 1 wherein the navigation panel is completely surrounded by the focal region.

8. The package of claim 1 further comprising a brand graphic located within the focal region.

9. The package of claim 1 wherein the framing pattern complexity value is less than 2.

10. The package of claim 9 wherein the focal pattern complexity value is at least 10.

11. The package of claim 1 wherein the framing region is divided into a first framing region and a second framing region, wherein the focal region completely separates the first framing region from the second framing region on the display face.

12. A package comprising an outer structure having at least one display face, the display face having a first framing region, a second framing region, and a focal region wherein the focal region completely separates the first framing region from the second framing region on the display face, wherein the first framing region has a first printed pattern having a first pattern complexity value and the second framing region has a second printed pattern having a second complexity value, and the focal region has a focal printed pattern having a focal complexity value, wherein the difference between the first pattern complexity value and the focal complexity value is at least 3 and the difference between the second pattern complexity value and the focal complexity value is at least 3.

13. The package of claim 12 wherein the difference between the first pattern complexity value and the second pattern complexity value is less than 1.

14. The package of claim 12 wherein the focal region has a background color having a lowest L* value, the first framing region has a first background color having a lowest L* value, and the second framing region has a second background color having a lowest L* value, wherein the lowest L* value for the background color of the focal region is at least 10 less than the lowest L* value for the first background color of the first framing region and the lowest L* value for the second background color of the second framing region.

15. The package of claim 12 wherein the display face includes a navigation panel, the navigation panel defines a navigation panel area and a majority of the navigation panel area is located within the focal region.

16. The package of claim 15 wherein the navigation panel includes a printed pattern having a pattern complexity value of at least 2 more than the pattern complexity value of the focal pattern.

17. The package of claim 15 wherein the focal region has a background color having a lowest L* value, the first framing region has a first background color having a lowest L* value, the second framing region has a second background color having a lowest L* value, and the navigation panel has a navigation background color having a lowest L* value, wherein lowest L* value for the background color of the focal region is at least 10 less than the lowest L* value for the background color of the first framing region and the second framing region, and the lowest L* value for the background color of the focal region is at least 10 less than the lowest L* value for the background color of the navigation panel.

18. A merchandizing system comprising, a first product having a first product form and a first performance characteristic and a second product having a second product form and a second performance characteristic, wherein the first product form is different than the second product form or the first performance characteristic is different than the second performance characteristic, wherein the first product is contained in a first package comprising an outer structure having at least one display face, the display face having a framing region and a focal region wherein the framing region has a framing pattern having a framing pattern complexity value and the focal region has a focal pattern having a focal pattern complexity value wherein the difference between the framing pattern complexity value and the focal pattern complexity value is at least 3, and wherein the second product is contained in a second package comprising an outer structure having at least one display face, the display face having a framing region and a focal region wherein the framing region has a framing pattern having a framing pattern complexity value and the focal region has a focal pattern having a focal pattern complexity value wherein the difference between the framing pattern complexity value and the focal pattern complexity value is at least 3.

19. The merchandizing system of claim 18 wherein the first product form is an incontinence pad and the first product performance characteristic is a first absorbency and wherein the second product form is an incontinence pad and the second product performance characteristic is a second absorbency, wherein the first absorbency and the second absorbency are different.

20. The merchandizing system of claim 19 further comprising display structure wherein the display structure has an outer structure having at least one display face, the display face having a framing region and a focal region wherein the framing region has a framing pattern having a framing pattern complexity value and the focal region has a focal pattern having a focal pattern complexity value wherein the difference between the framing pattern complexity value and the focal pattern complexity value is at least 3.

* * * * *